US009440826B2

(12) United States Patent
Prisk

(10) Patent No.: US 9,440,826 B2
(45) Date of Patent: Sep. 13, 2016

(54) LOCKING EXTENSION DEVICE

(71) Applicant: ABSOLUTE EQUIPMENT PTY LIMITED, Queensland (AU)

(72) Inventor: Thomas Prisk, Queensland (AU)

(73) Assignee: ABSOLUTE EQUIPMENT PTY LIMITED, Queensland (AU)

( * ) Notice: Subject to any disclaimer, the term of this patent is extended or adjusted under 35 U.S.C. 154(b) by 58 days.

(21) Appl. No.: 14/381,317

(22) PCT Filed: Feb. 28, 2013

(86) PCT No.: PCT/NZ2013/000024
§ 371 (c)(1),
(2) Date: Aug. 27, 2014

(87) PCT Pub. No.: WO2013/129946
PCT Pub. Date: Sep. 6, 2013

(65) Prior Publication Data

US 2015/0053904 A1 Feb. 26, 2015

(30) Foreign Application Priority Data

Feb. 28, 2012 (AU) ..... 2012900756

(51) Int. Cl.
*F15B 15/26* (2006.01)
*B66F 3/30* (2006.01)

(52) U.S. Cl.
CPC ..... *B66F 3/30* (2013.01); *F15B 15/261* (2013.01); *F15B 15/262* (2013.01); *F15B 15/264* (2013.01)

(58) Field of Classification Search
CPC .. F15B 15/264; F15B 15/262; F15B 15/261; F15B 15/24; B66F 3/30
See application file for complete search history.

(56) References Cited

U.S. PATENT DOCUMENTS 2,540,578 A 2/1951 Hall et al.
2,713,328 A * 7/1955 Driskel ..... F15B 15/261 92/24
3,094,841 A * 6/1963 Pearne ..... B60S 9/10 60/442

(Continued)

FOREIGN PATENT DOCUMENTS

AU 1996071744 5/1997
DE 198 00 296 7/1999
WO 9636555 11/1996

OTHER PUBLICATIONS

European Search Report, mail date is Sep. 4, 2015.

(Continued)

*Primary Examiner* — Monica Carter
*Assistant Examiner* — Seahee Yoon
(74) *Attorney, Agent, or Firm* — Greenblum & Bernstein, P.L.C.

(57) ABSTRACT

The invention relates to an extension device, lifting device or jack that can be locked in a raised configuration and used to safely support a raised load. An extension device according to the invention comprises a housing having a closed first end and an open second end, a support member inside the housing projecting from the first end thereof, a piston slideably mounted in the housing around the support member, means for extending the piston out of the second end of the housing, means for retracting the piston into the housing, and a locking mechanism for releasably locking the piston to the support member, wherein the locking mechanism comprises one or more locking members mounted on the support member operable to be selectively moved in and out of locking engagement with the piston.

20 Claims, 5 Drawing Sheets

(56) References Cited

U.S. PATENT DOCUMENTS

| | | | | | |
|---|---|---|---|---|---|
| 3,159,973 | A | * | 12/1964 | Pearne | B66F 3/30 60/442 |
| 3,251,278 | A | * | 5/1966 | Royster | F15B 15/261 285/920 |
| 3,584,544 | A | * | 6/1971 | Haberman | F15B 15/261 74/531 |
| 4,951,552 | A | * | 8/1990 | Fox | F15B 15/261 91/45 |
| 5,000,424 | A | | 3/1991 | Inoue | |
| 5,205,203 | A | | 4/1993 | Rossato | |
| 5,692,851 | A | * | 12/1997 | Pace | F15B 15/261 403/31 |
| 5,755,540 | A | * | 5/1998 | Bushnell | B60P 3/08 410/26 |
| 6,832,540 | B2 | * | 12/2004 | Hart | F15B 15/2807 92/24 |
| 7,413,166 | B2 | | 8/2008 | Arzouman | |
| 2008/0022849 | A1 | | 1/2008 | Kamenz et al. | |

OTHER PUBLICATIONS

Search report from PCT/NX2013/000024, mail date is May 24, 2013.

International Preliminary Report on Patentability, mail date is Jun. 30, 2014.

Written Opinion of the International Searching Authority, mail date is May 24, 2013.

Written Opinion of the International Searching Authority, mail date is Oct. 17, 2013.

* cited by examiner

LOCKING EXTENSION DEVICE

FIELD OF INVENTION

The invention relates to extension devices, lifting devices or jacks. More particularly, the invention relates to such devices that can be locked in a raised configuration and used to safely support a raised load.

BACKGROUND TO THE INVENTION

Devices able to extend to force two objects apart come in a number of forms. One common example is a device used to extend the distance between an object and the ground on which it rests, thereby raising the object, i.e. a jack. Jacks are used to lift objects off the ground. They are used in many situations, although raising vehicles is perhaps the most well-known use. Raising a vehicle off the ground enables maintenance or repairs to be carried out, for example changing a tyre or by allowing easy access to the underside of the vehicle. Jacks may also be used to, for example, lift houses off their foundations.

Some kinds of jacks use mechanical advantage to allow a vehicle (or other object) to be lifted by manual force alone. For example, screw jacks operate by the manual winding of a screw in order to raise the jack. Some such jacks may be conveniently stored in a vehicle for emergencies.

Hydraulic jacks operate on the principle of injecting an incompressible fluid into a chamber below a piston. This causes the piston to rise up out of a housing. The top of the piston pushes an object upwards as it rises.

As well as lifting a load, devices are also required to safely maintain the load in the lifted position for an unspecified duration of time, after which the load may be released and safely lowered. In some instances, one piece of equipment is used to lift the load and a separate apparatus is used to support the load in the lifted position. In Australia and New Zealand, different safety standards govern the two functions and separate pieces of equipment for each function allows the respective equipment to be tailored to conform to the relevant standards.

Some jacks are available that can perform both lifting and supporting functions to the respective standards. This is advantageous as only a single device is required, saving on space and handling. Also, some loads have only a limited number of locations suitable for a lifting or supporting force to be applied so finding two locations for fitting separate lift and support devices can be difficult.

Integrated lift and support devices often take the form of conventional jacks incorporating fail-safe devices to support the load in the event the mechanism supporting the jacking function malfunctions. Such fail-safes may comprise mechanical locking mechanisms so that, even if the hydraulic mechanism fails, the piston is maintained at a certain height unless the mechanical lock is disengaged.

Some prior art jacks have locking mechanisms located externally to the device. In such devices, the locking mechanisms are vulnerable to contamination, corrosion or mechanical damage. External mechanisms can also expose operators and other equipment to dangerous entrapment or pinching.

U.S. Pat. No. 2,540,578 discloses a hydraulic jack in which a piston is extendable out of a cylinder upon injection of hydraulic fluid into the chamber below the piston. The cylinder can be locked in an extended position by engagement of a locking device mounted on the inside of the cylinder with ratchet grooves on a post inside the piston. The post only has ratchet grooves down opposing sides. Therefore to release the locking mechanism, the locking device is rotated through 90° by means of a handle, thereby moving the locking device out of alignment with the grooves and allowing the piston to freely move up and down the cylinder and post. Although some parts of the locking mechanism of this jack are internal to the piston, the handle is external and could be vulnerable to being knocked, releasing the lock. In addition, an operator must manually turn the handle to lock/unlock the mechanism. Manual locking mechanisms in general are vulnerable to user error. To reach the handle may require the operator to put part of their body under the supported load, which could be unsafe.

U.S. Pat. No. 5,205,203 discloses a hydraulic cylinder unit intended to be used in a pantograph-type vehicle jack. The cylinder comprises a piston which extends out of a cylinder when hydraulic fluid is injected through an aperture into the chamber below the piston. Inside the piston is a rod fixed to the cylinder. A locking mechanism between the piston and rod is provided in a flange on the piston. The locking mechanism is operated by hydraulic fluid in the cylinder and is therefore prone to failure in the event of fluid loss in the cylinder.

It is an object of the invention to provide an improved jack that can be used to safely lift and support a load. Alternatively, it is an object to address at least some of the aforementioned problems of the prior art. Alternatively, it is an object of the invention to at least provide the public with a useful choice.

SUMMARY OF THE INVENTION

According to a first aspect of the invention, there is provided an extension device comprising:

- a housing having a closed first end and an open second end;
- a support member inside the housing projecting from the first end thereof;
- a piston slideably mounted in the housing around the support member;
- means for extending the piston out of the second end of the housing;
- means for retracting the piston into the housing; and
- a locking mechanism for releasably locking the piston to the support member,
- wherein the locking mechanism comprises one or more locking members mounted on the support member operable to be selectively moved in and out of locking engagement with the piston.

Preferably, at least a part of the locking mechanism is located inside the support member.

Preferably, the locking mechanism comprises biasing means for biasing the locking mechanism into locking engagement with the piston.

Preferably, the means for extending the piston out of the housing and the means for retracting the piston into the housing comprise fluid control means for introducing and removing fluid from the housing below and optionally above a flange of the piston. For example, the piston may take the form of a double-acting cylinder.

In preferred embodiments, the locking mechanism further comprises fluid-controlled means for moving the locking members in and out of engagement with the piston.

Preferably, the locking mechanism comprises locking members operable to move radially relative to the extension device such that, in a radially extended position the locking members are engaged with the piston and, in a radially retracted position the locking members are not engaged with the piston.

More preferably, the locking mechanism comprises an elongate member slideably mounted inside the support member and a means for converting movement of the elongate member into radial movement of the locking members. For example, the means for converting movement may convert longitudinal movement of the elongate member into radial movement of the locking members.

In one embodiment, the locking mechanism comprises:

means for introducing fluid into the cavity to cause the elongate member to move in a first longitudinal direction in the cavity; and means for allowing fluid to exit the cavity to allow the elongate member to move in a second longitudinal direction in the cavity.

Preferably, the locking member comprises biasing means for urging the elongate member in the second longitudinal direction. More preferably, the biasing means comprises a spring mounted on the elongate member between a flange at the end of the elongate member and an abutment member inside the support member.

Preferably, the means for converting longitudinal movement into radial movement comprises a boss mounted on the first end of the elongate member, the boss being operably engaged with the locking members and transferring longitudinal movement of the elongate member into lateral movement of the locking members.

More preferably, the boss comprises at least one angled protrusion, each engaged with a recess in one of the locking members, the angled protrusions converting longitudinal movement of the boss into radial movement of the locking members.

In preferred embodiments, when the locking members are in locking engagement with the piston, the piston is prevented from receding into the housing but is able to extend further out of the housing. In one embodiment, the piston and locking mechanism together form a ratchet mechanism.

Preferably, the piston comprises a plurality of grooves on an inner surface and the locking members comprise one or more projections adapted to engage one or more of the grooves when in locking engagement. More preferably, the grooves and/or projections have a flat edge and a sloping edge.

In preferred embodiments of the invention, the housing and support member are mounted on a base section. For example, the housing may comprise a hollow cylinder mounted on the base section to thereby close the first end of the housing.

Preferably, the fluid able to be introduced into the housing and/or the cavity in the support member is a liquid. Alternatively, the fluid able to be introduced into either or both housing or cavity is a gas. As such, the extension device and locking mechanism may be operated by either hydraulic or pneumatic, means, or by a combination of the two.

In preferred embodiments, the extension device comprises means for indicating whether the locking mechanism is in a locked or unlocked configuration. Preferably, the means for indicating whether the locking mechanism is in a locked or unlocked configuration comprises means for detecting the position of the elongate member, or means for translating the position of the elongate member into a change in state of an indicator device.

Preferably, the extension device is operated by remote control. The extension device may be remotely operated by means of a device which comprises the means for indicating whether the locking mechanism is in the locked or unlocked configuration.

According to a second aspect of the invention, there is provided an extension system comprising a extension device according to the first aspect of the invention and a control device for controlling operation of the extension device.

Preferably, the control device is located remotely from the extension device.

More preferably, the control device remotely operates a plurality of valves that control the flow of fluid in the extension device.

Preferably, the control device comprises means for indicating whether a locking mechanism of the extension device is in a locked or unlocked configuration.

Further aspects of the invention, which should be considered in all its novel aspects, will become apparent to those skilled in the art upon reading of the following description which provides at least one example of a practical application of the invention.

BRIEF DESCRIPTION OF THE DRAWINGS

One or more embodiments of the invention will be described below by way of example only, and without intending to be limiting, with reference to the following drawings, in which.

DETAILED DESCRIPTION OF PREFERRED EMBODIMENTS OF THE INVENTION

For the purposes of the following description, extension devices according to embodiments of the invention will, by way of example, be discussed in relation to their use to lift loads upwards, i.e. as a jack. For the purposes of the following description, the term "jack" will be used and an upright orientation and upwards extension of the jack will be assumed, unless indicated otherwise. Extension devices according to embodiments of the invention could equally be used in other orientations, for example to provide a horizontal separation force. Positional terms like "up", "above", "below" and the like as used herein will be understood to apply to the upright orientation and do not limit the scope of the invention. Those of skill in the art will understand how these terms can be simply translated to apply to jacks in other orientations.

Figure 1:
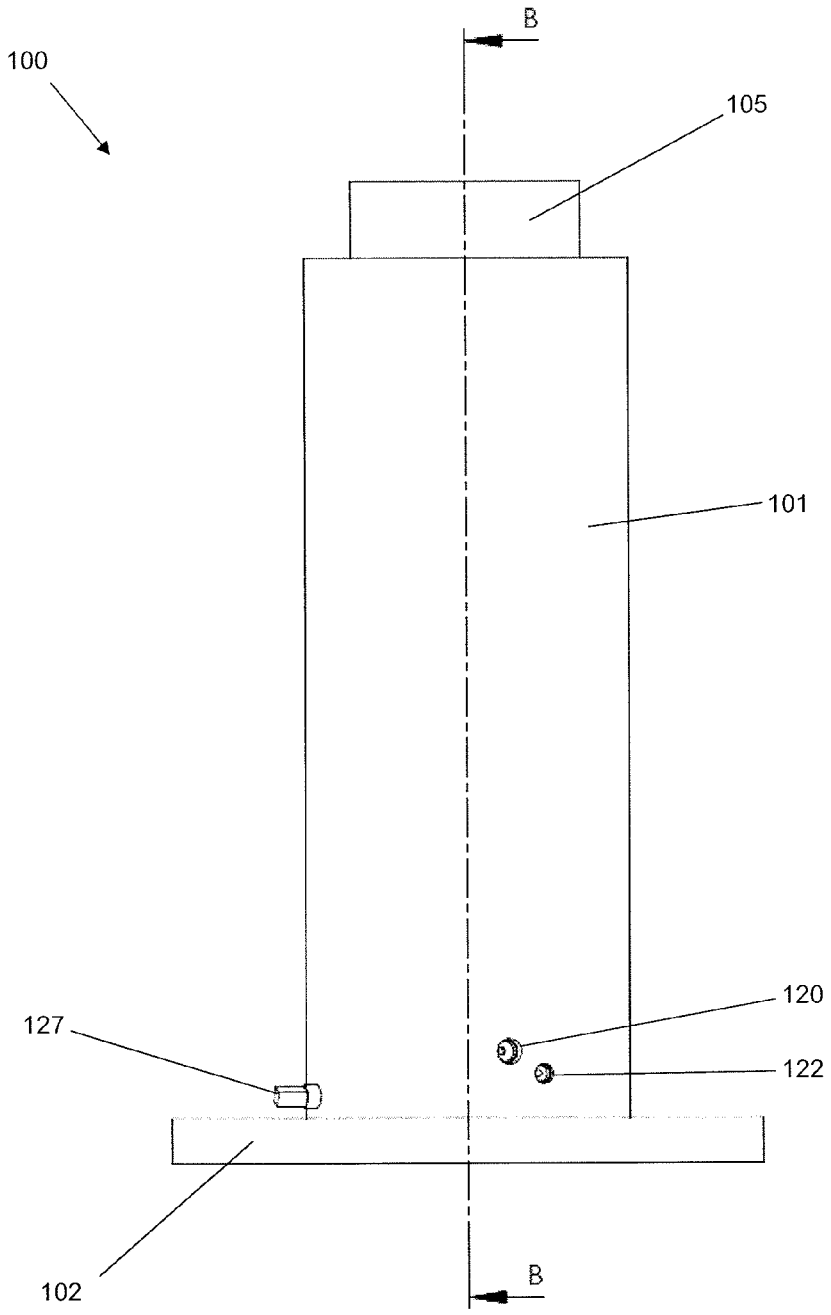
FIG. 1 is a side profile view illustration of a jack according to an embodiment of the invention.
Figure 2:
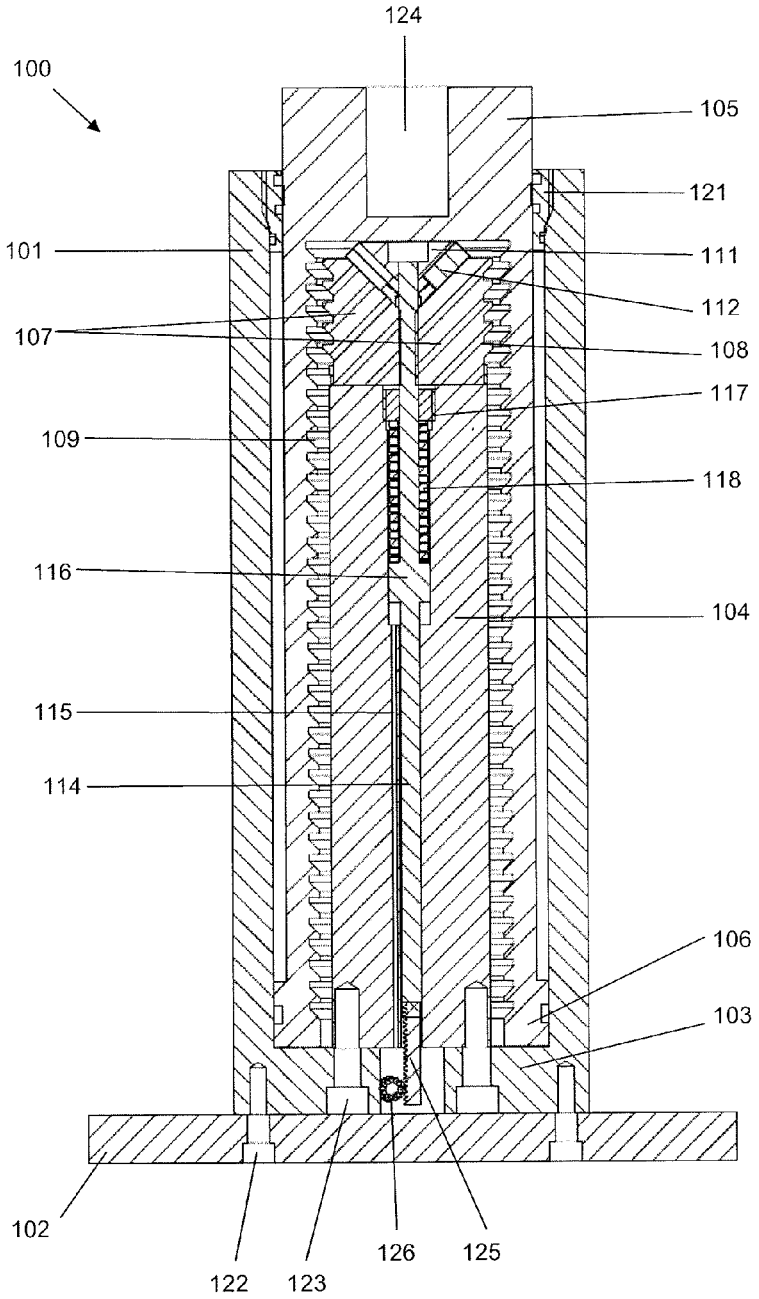
FIG. 2 is a cross-sectional illustration of the jack shown in FIG. 1.

FIG. 1 is a side profile view illustration of a jack 100 according to an embodiment of the invention. FIG. 2 is a cross-sectional illustration of the jack 100 shown in FIG. 1 through cross-section B-B of FIG. 1. Jack 100 comprises an outer housing 101, which is typically cylindrical in shape. Housing 101 is mounted on base 102 by means of bolts, screws or other suitable fasteners 122. Base 102 provides jack 100 with a solid foundation so that the jack can stand upright. The base may be mounted on wheels or the like to make the jack easily transportable. The bottom end of housing 101 is closed, either by virtue of end portion 103 or, in other embody ments, by part of the base 102. The upper end of housing 101 is open.

Provided inside of the housing 101 is a support column 104 mounted to the closed end of the housing by means of bolts or other suitable fasteners 123. Support column projects upwards from the closed end of the housing, is positioned co-axially inside it and is complimentary in shape to the housing, in this case being cylindrical. The support column 104 may be slightly shorter in height than the housing 101, as shown in FIG. 2.

Also inside housing 101 but around the support column 104 is mounted a piston 105. Piston 105 is mounted co-axially with the housing and support column and is again complimentary in shape with those members such that the piston 105 can slide up and down between the housing and the support column, in and out of the open end of the housing 101. The piston 105 may comprise an upper portion that, in the retracted position, extends above the level of the open end of the housing, as shown in FIGS. 1 and 2. At least a lower portion of the piston 105 is hollow such that the support column 104 is positioned inside the piston.

Piston 105 can be extended and retracted out from and in to housing 101 by any appropriate means. FIG. 2 illustrates one embodiment in which a hydraulic mechanism is used to perform both of these functions. Hydraulic mechanisms involve the use of fluids in liquid form to do mechanical work. It is known in the art that pneumatic mechanisms, which use fluids in gaseous form, may alternatively be used, or may be used in combination with hydraulics. Embodiments of the invention include jacks with both hydraulic and pneumatic mechanisms. The embodiment of FIG. 2 will be discussed as being operated by hydraulic means by way of example. Oil may be used as a hydraulic fluid in some embodiments. This has the advantage that, in these embodiments, much of the mechanism is bathed in oil, providing protection from wear and corrosion.

Piston 105 comprises a flange 106 at its bottom end. Flange 106 abuts the inner wall of housing 101 such that a fluid seal is created between the piston and housing. To this end, a gasket, O-ring or other sealing device may be mounted on the flange 106 to ensure the seal.

In the embodiment shown, the piston 105 and housing 101 forms a double-acting cylinder in which hydraulic fluid may be introduced and removed from both the chamber within the housing below the flange 106 and the chamber within the housing above the flange 106 to raise and lower the piston 105.

Port 120 in the side of housing 101 is in fluid communication with the chamber below flange 106 of piston 105. Another port (not shown) in the side of housing 101 is in fluid communication with the chamber above flange 106. Fluid is injected and removed from these ports using conventional means to raise and lower the piston. In other embodiments, port 120 may be provided in the base of the jack.

A gland nut 121 is provided near the top of the cylindrical housing 101, which acts to contain and guide piston 105 in its linear motion, and to seal the chamber above the flange 106 so it can contain hydraulic fluid.

A cavity 124 may be provided in the top of piston 105 for receiving load caps selected to suit a particular lifting task.

Locking Mechanism According to One Embodiment

Figure 3:
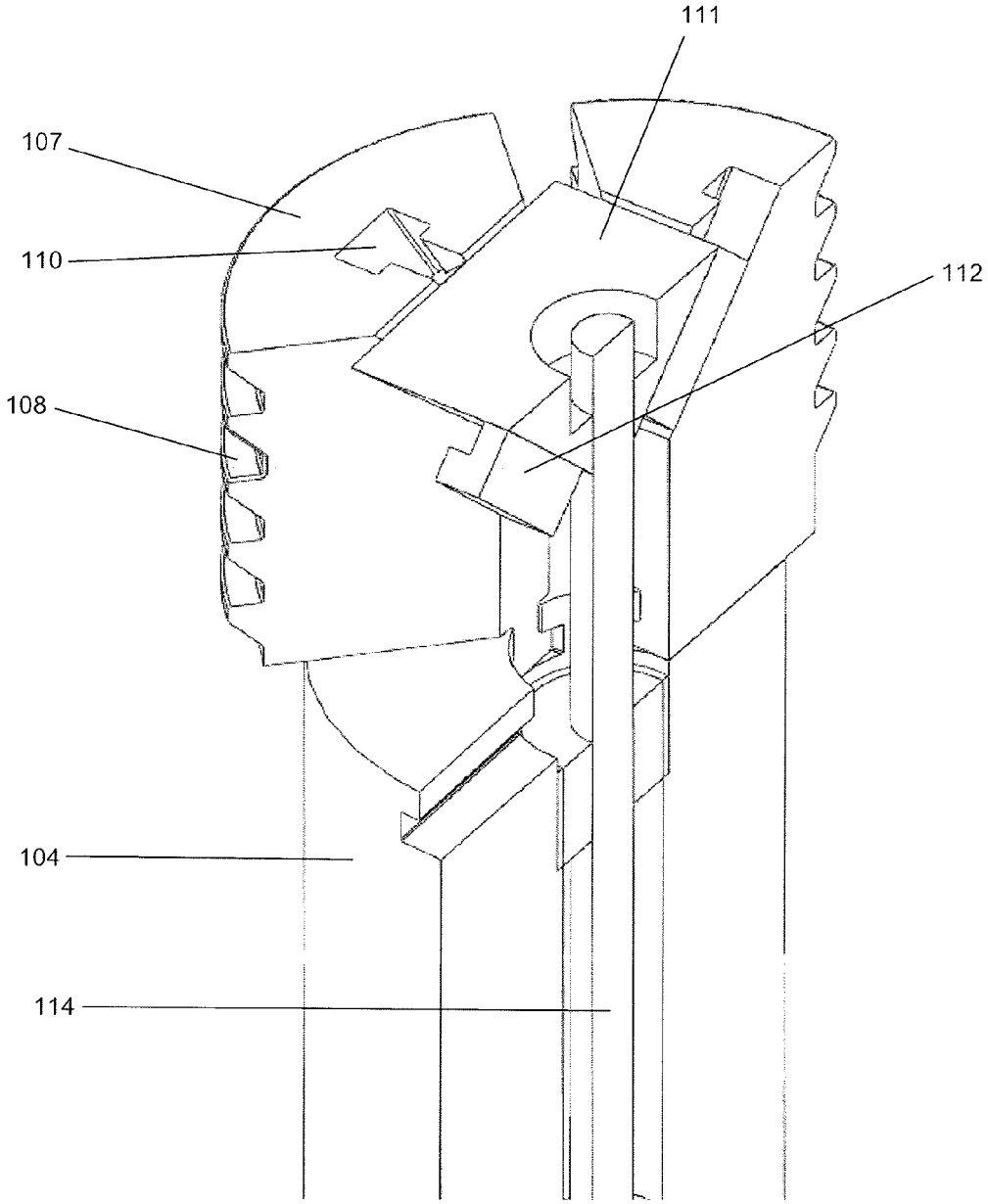
FIG. 3 is cross-sectional view illustration of the locking mechanism of the jack shown in FIGS. 1 and 2 in a locked configuration.
Figure 4:
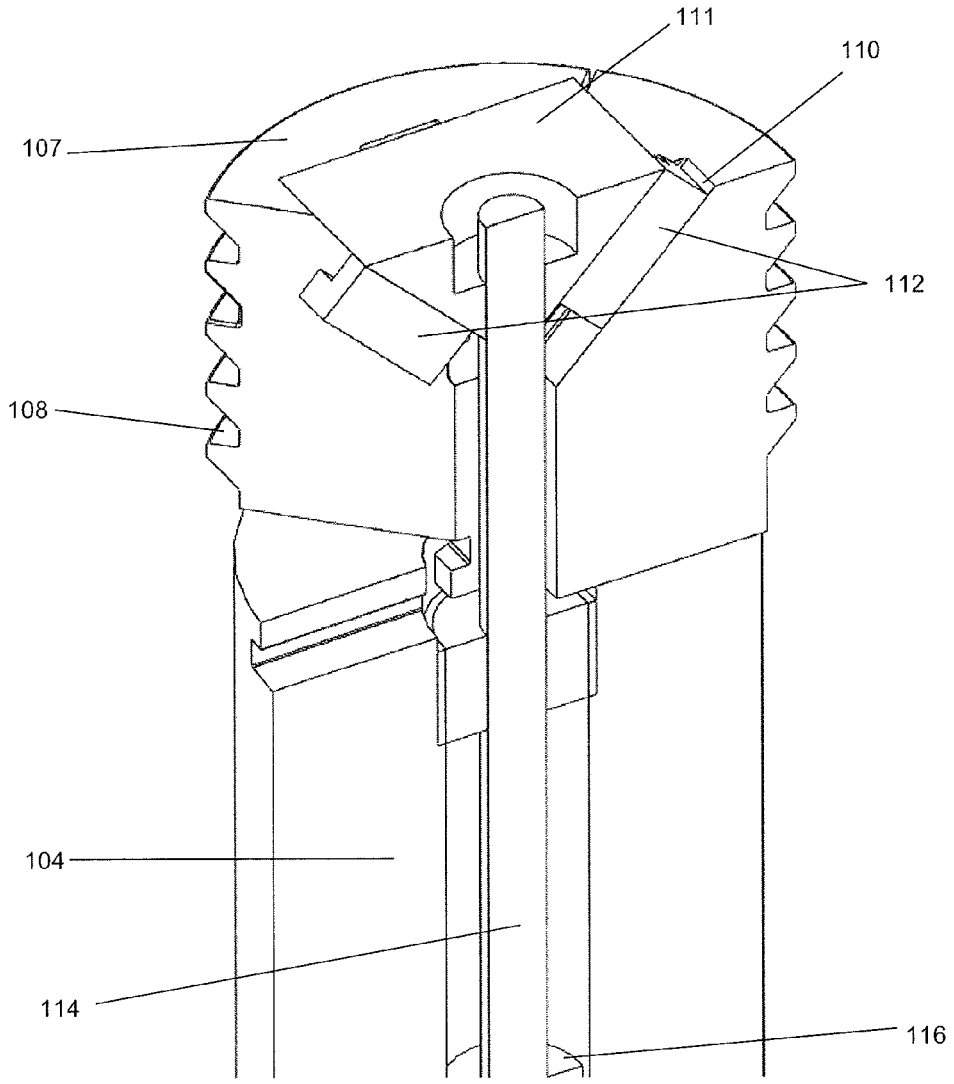
FIG. 4 is cross-sectional view illustration of the locking mechanism of the jack shown in FIGS. 1 and 2 in an unlocked configuration.

Jack 100 comprises a locking mechanism to safely maintain the jack in an extended position. A locking mechanism according to one embodiment will now be described. Components of the locking mechanism are labelled in FIG. 2 and the below description also refers to FIGS. 3 and 4, which are more detailed cross-sectional view illustrations of the locking mechanism of jack 100 in a locked and unlocked configuration respectively.

The piston 105 has a plurality of horizontal grooves 109 around its inner surface spaced along the height of the piston. Each groove has a horizontal upper surface and an angled lower surface. Equivalently, the grooves form projections between them, the projections having horizontal lower surfaces and angled upper surfaces.

The locking mechanism further comprises locking members mounted on support column 104. In the embodiment shown in FIGS. 2 to 4 in which the jack is generally cylindrical, the locking members comprise stops 107 mounted on the top of the support column (the front locking member is not shown in FIGS. 3 and 4 for illustrative purposes). There are four stops 107, each having a quarter-circle profile. The stops 107 are operable to be selectively moved radially in and out relative to the cylindrical geometry of jack 100. Stops 107 comprise one or more projections 108 on their outer surface. Each projection 108 has a horizontal upper surface and an angled lower surface adapted to mate with the grooves 109 on the inside of the piston. Stops 107 each comprise an angled recess 110 on an inner, upper side which is configured to receive a correspondingly shaped projection in mating engagement therewith. In the embodiment shown in the Figures, the angled recesses have a T-shaped profile. Other embodiments have a dove-tail shaped profile or any other suitable profile.

The locking mechanism also comprises a boss 111 which may take the form of an inverted pyramid. In the embodiment shown in which there are four stops, boss 111 is tetrahedral. Boss 111 is in sliding engagement with the angled recesses 110 of each stop 107 by means of protrusions 112, which are complimentary in shape to the recesses and therefore have a T-shaped profile in the embodiment shown. This structure means that boss 111 mechanically links all of the stops 107 such that the boss converts longitudinal movement into radial movement of the stops, as will be explained further below.

Boss 111 is mounted on one end of an elongate member such as a rod 114 that is positioned in a central elongate cavity 115 through the length of support column 104. Rod 114 is able to move up and down longitudinally within the cavity 115. One portion of rod 114 comprises a flange or piston 116, which is slidingly mounted inside the cavity 115 in a sealed manner, for example by means of an appropriate gasket or O-ring.

Jack 100 further comprises means for introducing fluid into cavity 115 underneath flange 116 and means for allowing fluid to exit said cavity. One or more ports 122 are provided in housing 101 through which the fluid can enter and exit.

A biasing means is provided to urge rod 114 in the downwards longitudinal direction. In the embodiment shown in FIG. 2, the biasing means comprises an abutment member in the form of shoulder 117 on the interior wall of support column 104 and a spring 118 positioned under compression between shoulder 117 and the upper side of flange 116. The spring provides a downwards force on flange 116, urging rod 114 downwards.

As such it will be understood that rod 114 forms part of a single-acting piston cylinder in which fluid is used to move the piston (i.e. rod 114) in a first direction and a counter-acting spring is used to move the piston in the opposing direction.

Operation of the Jack

The operation of jack 100 will now be described. In the absence of fluid in either the cavity beneath piston 105 or the cavity beneath flange 116 of rod 114, the piston is retracted into the housing 101 and the locking mechanism is engaged.

To raise the jack, fluid is injected through the port 120 in the bottom of the housing into the cavity beneath piston 105. Hydraulic pressure causes the piston 105 to move upwards, out of the top of housing 101. The profile of the grooves 109 on the inside of the piston 105 and the grooves 108 on the outside of the stops 107 forms a ratchet mechanism, which allows movement of the piston 105 in the upwards direction. Upwards movement of the piston 105 pushes stops 107 inwards by virtue of the sloping faces of the grooves 109 pushing against the sloping faces of grooves 108. In turn, the angled upwards facing faces of the recesses 110 of the stops 107 push against the angled downwards facing faces of the T-shaped protrusions 112, which causes the boss 111 to be pushed upwards, pulling the rod 114 upwards against the force of the spring 118 inside support column 104.

Once the piston 105 has moved upwards through a distance corresponding to the height of one of the grooves/projections in the locking mechanism, the stops 107 are released by the grooves of the ratchet mechanism and, since compression spring 118 urges rod 114 downwards, boss 111 is also urged downwards. The angled downwards facing faces of the T-shaped protrusions 112 of boss 111 push against the angled upwards facing faces of recesses 110 of stops 107, pushing the stops radially outwards and into locking engagement with the next set of grooves on the inside of the piston 105.

Since boss 111 mechanically links the movement of all the stops 107 together it ensures that all stops engage or release locking engagement with the piston. All stops engaging the piston may be important for satisfying the rated load carrying capacity of the jack.

In this position, the jack is locked by virtue of the piston 105 being locked to the support column 104. The profile of the ratchet grooves prevents the piston 105 moving downwards. The action of spring 118 means that the stops 107 are always urged to the radially extended (locked) position, thereby acting as a fail-safe. Even if there is hydraulic failure in the chamber below the piston 105, the mechanism self-locks because the stops are urged outwards. In the locked position, a load placed on top of piston 105 is supported through the stops 107, which are in turn supported by the support column 104, which is supported directly by the base of the jack.

To lower the jack, a small amount of fluid is initially injected into the cavity below the piston 105 to cause the jack to extend a very small amount. The effect of this is to relieve the load on the locking mechanism, meaning the locking mechanism can be retracted without the wear that would be caused if it was retracted under the full weight of the load.

Once the piston has been extended by the small amount, fluid is injected into the cavity beneath rod 114. The hydraulic pressure in this cavity increases until rod 114 is pushed upwards, against the action of spring 118. This causes boss 111 to move upwards and the angled upwards facing faces of the T-shaped protrusions 112 pull against the downwards facing faces of recesses 110, causing the stops to move inwards. In this way, the stops are disengaged from the piston.

Once the locking mechanism is disengaged, hydraulic fluid is injected into the cavity in the housing above flange 106 of piston 105, increasing the hydraulic pressure acting downwards on the piston. At the same time, fluid is allowed to exit the bottom of housing 101 through the port 120 in the base. This causes the piston 105 to lower. At any point, lowering can be stopped, by stopping the injection of hydraulic fluid into the housing above the piston flange 106 and/or by reducing the hydraulic pressure in the chamber under rod 114 so that the locking mechanism re-engages.

If the hydraulic mechanism fails (i.e. the mechanism controlling the pressure of fluid under the piston 105 and the mechanism controlling the pressure of fluid under rod 114), then the locking mechanism will automatically engage because of spring 118 urging the rod 114 downwards and the piston will be held by the locking mechanism. During extension, the hydraulic pressure is open to the rod 114 and the piston 105. Due to approximately equivalent areas on the rod flange 116, both of which are subject to the same pressure, the principal net force is downwards, produced by the spring 118. This means, that during extension, failure of hydraulic pressure to one of the hydraulic mechanisms would mean loss of pressure to the underside of both pistons, and therefore the self-locking mechanism would lock and the load would be supported.

The height of the projections/grooves on the inside of the piston and the outside of the stops determine the distance between available lockable positions of the jack. By appropriate adjustment of the dimensions of the locking grooves/projections, the incremental distance between locking positions can be varied. Grooves of a smaller height mean a smaller incremental distance between available locking positions.

In the embodiment shown, the angle of the recesses 110 of stops 107 and the T-shaped protrusions 112 of boss 111 to the main axis of the jack is approximately 45°. This results in a 1:1 ratio between the magnitude of movement of rod 114 in the longitudinal direction and the magnitude of movement of stops 107 in the radial direction. The ratio of the forces exerted by the rod and stops is also 1:1 in this embodiment. The angle of the recesses and stops can be varied in other embodiments if other ratios are required, as will be understood to the skilled addressee.

One advantage of locking mechanisms according to embodiments of the invention, such as that described above, is that the components are internal to the jack. The mechanism is therefore protected from interference, damage and contamination which could affect its operation. The internal componentry also avoids any risk of operators or nearby equipment being trapped in the mechanism, causing injury or damage to the operators, jack and/or nearby equipment.

Moreover, at least some of the components of the locking mechanism are internal to the support member. For example, in the embodiment shown in FIGS. 2 to 4, the rod 114 the components controlling its movement are positioned inside support column 104. This is an efficient use of space, enabling a resolute locking mechanism to be incorporated into a compact form of a jack without compromising on the load able to be supported by the jack.

Control System

A control system is provided to enable the operation of the jack to be controlled by a user. Any control system appropriate to the mechanisms used to operate the jack may be provided. In some embodiments of the invention, the operation of the jack is controlled remotely so that a user does not need to physically go under a load to control the jack during the lifting operation.

In the embodiment of the invention illustrated in FIGS. 1 to 4, the piston and locking mechanism are controlled by hydraulic operation. A suitable network of control valves may be used to control the hydraulics of the system. The control valves may be located remote from the jack and/or the componentry controlling the control valves may be located remotely.

Figure 5:
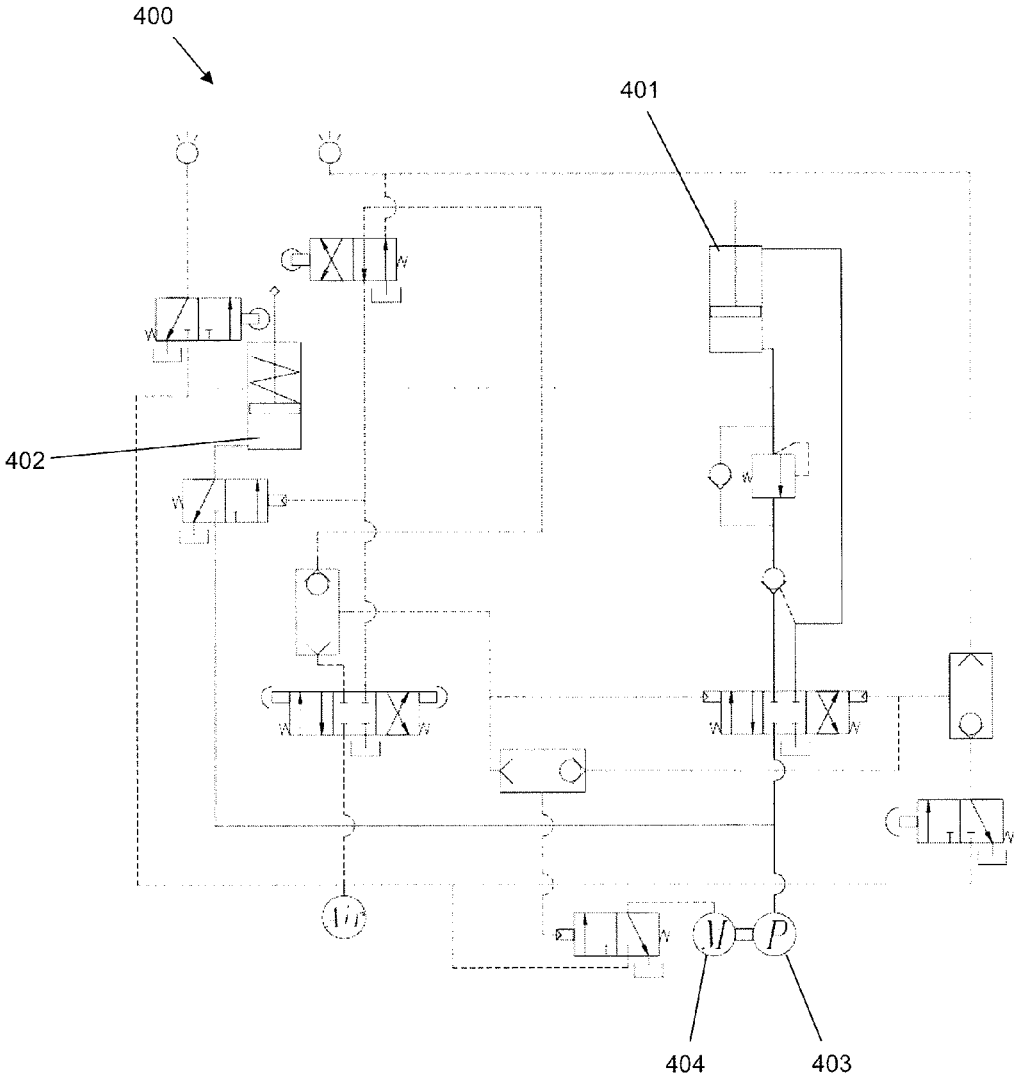
FIG. 5 is a schematic diagram of a control system for operating a jack according to an embodiment of the invention.

FIG. 5 is a schematic diagram of a control system 400 for operating a jack according to an embodiment of the invention. Control system 400 is suitable for operating a jack similar to jack 100 described in relation to FIGS. 1 to 4 operating under pneumatic power. In the schematic, the main piston of the jack is depicted as a double-acting cylinder 401 and the rod controlling the locking mechanism is depicted as single-acting cylinder 402. Also shown are pump 403, motor 404 and a plurality of valves.

Control system 400 uses a single source of fluid to control the operation of the jack. The fluid source is diverted to the two cylinders via valves. In alternative embodiments of the invention, different sources of fluid may be used for the double-acting and single-acting cylinders.

The schematic illustrates that, to release the locking mechanism, fluid is applied to both cylinders 401 and 402 to both extend the piston by a small amount to relieve the load on the locking mechanism and to release the locking mechanism. Once the lock releases and is fully retracted a signal is sent to the double-acting cylinder 401 to drive the main piston in the retract direction.

The control system may comprise means for indicating whether the locking mechanism is in a locked or unlocked configuration. The means for indicating may comprise an indicator on a control device or other display means by which a user can receive a visual indication of the configuration of the locking mechanism, and is thereby informed as to whether the jack is safe to use, or whether a worker is safely able to go under the supported load to perform whatever tasks are necessary.

In the embodiment of the invention illustrated in FIGS. 1 to 4, the locking state indication means comprises a means for translating the position of the rod 114 into a change in state of an indicator device since, when the rod is raised the locking mechanism is unlocked and when the rod is lowered the locking mechanism is locked.

Jack 100 comprises a rack 125 mounted on rod 114 in co-operation with a pinion 126 mounted through housing 101 and connected to a shaft 127 extending out of the side of the housing 101 and able to rotate as the pinion 126 rotates. Movement of the rod 114 up and down, i.e. between its position corresponding to the locked and unlocked configurations of the stops 107, causes the pinion 126 and hence the shaft 127 to rotate clockwise and anti-clockwise.

The shaft 127 may be further connected to any mechanism or device suitable for translating its clockwise/anti-clockwise rotation into an indication to a user as to the configuration of the locking mechanism. In one embodiment, the shaft is in engagement with tabs which actuate two valves. The valves in turn actuate an indicator device that is visible to an operator, for example on a pendant or other hand-held device.

Alternative Embodiments of the Invention

The embodiment of the invention shown in FIG. 1 shows a jack that comprises a locking mechanism allowing the jack to extend but preventing the jack from retracting unless the locking mechanism is disengaged. In an alternative embodiment of the invention, the jack comprises a locking mechanism that achieves the reverse: the piston is able to retract but cannot extend without release of the locking mechanism. Such devices may be used in certain situations, for example where jacks are used as links in lifting, in conjunction with typical lifting slings, wire ropes or chains. In these examples, when a large load is lifted and is ready to be placed into position, rather than having to re-sling to adjust leg lengths and hence load position, hydraulically adjustable cylinders allow precise positioning and trimming of the item during the lift.

To achieve this, the ratchet profile of the grooves on the inside of the piston and the outside of the stops are reversed. That is, the grooves on the inside of the piston have sloping upper surfaces and flat lower surfaces, and the grooves on the outside of the stops compliment this profile.

Suitable minor alteration to the relative sizes of other components of the jack may need to be altered in this 'tension' version of the jack, and such alterations will be evident to those of skill in the art.

Described above in relation to FIGS. 1 to 4 is one example of a locking mechanism of which a part is located inside the support column of the jack. Other embodiments of the invention comprise other locking mechanisms which also have parts located within the support column. Further examples will now be mentioned.

In one embodiment, the stops are connected to the axially moving rod by individual linkages that rotate in an outwards direction that push the stops outwards to engage the piston grooves upon downwards movement of the rod.

In certain embodiments, the locking mechanism comprises a locking member having one or more cams or other projections positioned on top of the support column and mounted such that axial rotation of the locking member is converted into radial movement to cause the cams to push the stops radially outwards. Further rotation or counter rotation of the locking member causes the stops to retract, by means of springs and/or mechanical linkage between the locking member and the stops. Rotation of the locking member may be controlled by rotation of a rod passing through the support column, which may in turn be rotated by any appropriate mechanism either directly (for example, using a rotating actuator in the base of the jack) or indirectly (for example, by rotation of a further rod, rotatably coupled to the rod through right-angles in the base of the jack).

In related embodiments, the cams of the locking member directly engage with the grooves on the inside of the piston and there are no separate stops. The cams may be appropriately profiled to provide the ratchet action as has been discussed above in relation to FIG. 1.

In further embodiments, the stops are actuated directly by hydraulic or pneumatic mechanism. For example, hydraulic fluid may be contained in the cavity through the support column and the stops may be mounted in a sealed casing such that they are moved outwards and inwards by increases and decreases in pressure of the hydraulic fluid (functioning analogously to a hydraulic brake). Such embodiments may include a mechanical interlock between the stops to ensure they extend and retract together. The fluid actuation may be single acting (only extending or only retracting the stops, with mechanical means provided to perform the action not performed by the fluid actuation) or double acting (both extending and retracting the stops).

In the case of a single acting hydraulic mechanism for the locking mechanism, a spring or other biasing device is used to urge the mechanism into the locked configuration, making the device self-locking. This is equivalent to the embodiment of the invention discussed in relation to FIGS. 1 to 4, except without the intermediate mechanical locking mechanism comprising the rod and boss.

Another way of biasing the stops outwards in some embodiments, including in the case of a double acting hydraulic mechanism, the jack comprises a hydraulic pressure reserve, such as an accumulator. In these embodiments, a low stored pressure is permanently applied to one side of the locking mechanism to ensure a bias towards the locking configuration such that, if pressure is removed from the side of the double acting cylinder urging the mechanism towards the unlocked configuration, the locks automatically re-engage. One disadvantage of such embodiments is that the mechanism relies on fluid action rather than positive mechanical action.

In other embodiments other means may be used for extending and retracting the piston from the housing, including pneumatic or mechanical mechanisms. For example, a rack may be mounted on the piston in co-operation with a pinion that is wound to raise or lower the piston. In such an embodiment, the control system may comprise motors and remote control means for controlling said motors, as will be known in the art. Alternatively, the piston may form a single-acting hydraulic or pneumatic cylinder in which the piston retracts by the removal of fluid from the chamber beneath the piston under its own weight, the weight of the load and/or atmospheric pressure.

In alternative embodiments of the invention, other means may be provided for indicating whether the locking mechanism is in a locked/unlocked configuration. For example, one or more switching devices such as electrical switches or the like may be used to detect the position of rod 114. For example, an electrical switch may be positioned such that terminals positioned on the rod 114 and on another part of the jack are only in contact when the rod is fully lowered, indicating the locking mechanism is locked. The switch may be in wired or wireless communication with a suitable indicator device. Alternatively, an appropriate switching device may directly detect the position of the stops.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to".

The entire disclosures of all applications, patents and publications cited above and below, if any, are herein incorporated by reference.

Reference to any prior art in this specification is not, and should not be taken as, an acknowledgement or any form of suggestion that that prior art forms part of the common general knowledge in the field of endeavour in any country in the world.

The invention may also be said broadly to consist in the parts, elements and features referred to or indicated in the specification of the application, individually or collectively, in any or all combinations of two or more of said parts, elements or features.

Where in the foregoing description reference has been made to integers or components having known equivalents thereof, those integers are herein incorporated as if individually set forth.

It should be noted that various changes and modifications to the presently preferred embodiments described herein will be apparent to those skilled in the art. Such changes and modifications may be made without departing from the spirit and scope of the invention and without diminishing its attendant advantages. It is therefore intended that such changes and modifications be included within the present invention.

The invention claimed is:

1. A locking jack comprising:

a housing having a closed first end and an open second end;

a support member inside the housing projecting from the first end thereof;

a piston slideably mounted in the housing around the support member, the piston operable to be extended out of the second end of the housing and retracted into the housing; and a locking mechanism for releasably locking the piston to the support member, wherein the locking mechanism comprises at least one locking member mounted on the support member operable to be selectively moved in and out of locking engagement with the piston, and wherein, when the at least one locking member is in locking engagement with the piston, the piston is prevented from moving in a first longitudinal direction relative to the housing but is able to move in a second, opposite, longitudinal direction relative to the housing.

2. The locking jack of claim 1, wherein at least a part of the locking mechanism is located inside the support member.

3. The locking jack of claim 1, wherein the locking mechanism comprises a biasing mechanism operable to bias the locking mechanism into locking engagement with the piston.

4. The locking jack of claim 1, wherein the locking jack is operable to extend the piston out of the housing by introducing and removing fluid from the housing at a position that is at least one of below and above a flange of the piston.

5. The locking jack of claim 1, wherein the locking jack is operable to retract the piston into the housing by introducing and removing fluid from the housing at a position that is at least one of below and above a flange of the piston.

6. The locking jack of claim 1, wherein the piston is in the form of a double-acting cylinder.

7. The locking jack of claim h wherein the locking mechanism further comprises a fluid-controlled mechanism operable to move the at least one locking member in and out of engagement with the piston.

8. The locking jack of claim 7, wherein the locking mechanism is configured to move the at least one locking member into engagement with the piston upon failure of the fluid-controlled mechanism.

9. The locking jack of claim 1, wherein, the at least one locking member is operable to move radially relative to the locking jack such that, in a radially extended position the at least one locking member is engaged with the piston and, in a radially retracted position the at least one locking member is not engaged with the piston.

10. The locking jack of claim 1, wherein when the at least one locking member is in locking engagement with the piston, the piston is prevented from receding into the housing but is able to extend further out of the housing.

11. The locking jack of claim 1, wherein the piston comprises a plurality of grooves on an inner surface and the at least one locking member comprise one or more projections adapted to engage one or more of the grooves when in locking engagement.

12. The locking jack of claim 1, wherein the locking jack and locking mechanism are at least one of hydraulically and pneumatically operated.

13. A locking jack comprising:

a housing having a closed first end and an open second end;

a support member inside the housing projecting from the first end thereof;

a piston slideably mounted in the housing around the support member, the piston operable to be extended out of the second end of the housing and retracted into the housing; and a locking mechanism for releasably locking the piston to the support member, wherein the locking mechanism comprises at least one locking member mounted on the support member operable to be selectively moved in and out of locking engagement with the piston, wherein, when the at least one locking member is in locking engagement with the piston, the piston is prevented from moving in a first longitudinal direction relative to the housing but is able to move in a second, opposite, longitudinal direction relative to the housing; and wherein the locking mechanism comprises an elongate member mounted inside the support member, the elongate member being operable to urge the at least one locking member into locking engagement with the piston via an interlocking mechanism configured to convert movement of the elongate member into lateral movement of the at least one locking member, and the elongate member being further operable to urge the at least one locking member out of locking engagement with the piston via the interlocking mechanism.

14. The locking jack of claim 13, wherein the at least one locking member is at least two in number, and the elongate member is operable to urge each of the locking members to move laterally to the same extent as each of the other locking members.

15. The locking jack of claim 13, wherein the elongate member is biased to urge the at least one locking member into locking engagement with the piston.

16. The locking jack of claim 13, wherein the locking mechanism comprises:

a mechanism operable to introduce fluid into a cavity to cause the elongate member to move in a first longitudinal direction in the cavity; and a mechanism operable to allow fluid to exit the cavity to allow the elongate member to move in a second longitudinal direction in the cavity.

17. The locking jack of claim 16, wherein the elongate member is biased by a spring mounted on the elongate member between a flange of the elongate member and an abutment member inside the support member.

18. The locking jack as claimed in claim 13, wherein the interlocking mechanism configured to convert movement of the elongate member into lateral movement of the at least one locking member comprises a mechanical connection between the elongate member and the at least one locking member such that the mechanical connection transfers longitudinal movement of the elongate member into lateral movement of the at least one locking member.

19. The locking jack as claimed in claim 18, wherein, the mechanical connection comprises a boss mounted on the elongate member, having one or more angled protrusions, each engaged with a recess in the at least one locking member, the angled protrusions converting longitudinal movement of the boss into radial movement of the at least one locking member.

20. The locking jack of claim 13, wherein the locking jack comprises an indicator external to the locking jack to indicate whether the locking mechanism is in a locked or unlocked configuration.

* * * * *